US007367834B1

(12) United States Patent
Lin et al.

(10) Patent No.: US 7,367,834 B1
(45) Date of Patent: May 6, 2008

(54) ELECTRICAL CONNECTOR

(75) Inventors: Kuo-Chin Lin, Tu-Cheng (TW); Bo Liu, Tu-Cheng (TW); Feng Zhu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/742,498

(22) Filed: Apr. 30, 2007

(51) Int. Cl.
*H01R 13/625* (2006.01)

(52) U.S. Cl. ..... 439/345; 439/83; 439/358; 439/607

(58) Field of Classification Search ..... 439/83, 439/345, 358, 607, 876
See application file for complete search history.

(56) References Cited

U.S. PATENT DOCUMENTS 4,842,529 A * 6/1989 Frantz et al. ..... 439/95
6,685,495 B1 * 2/2004 Ko ..... 439/353
6,929,500 B2 * 8/2005 Noro ..... 439/358
6,957,976 B2 * 10/2005 Zhang ..... 439/358
6,976,876 B1 * 12/2005 Su et al. ..... 439/607
D552,553 S * 10/2007 Lin et al. ..... D13/147
2004/0121632 A1 * 6/2004 Takata ..... 439/83
2005/0070148 A1 * 3/2005 Zhang ..... 439/358
2006/0128219 A1 * 6/2006 Zhang et al. ..... 439/607
2006/0292930 A1 * 12/2006 Shimoyama ..... 439/607
2007/0243764 A1 * 10/2007 Liu et al. ..... 439/607

* cited by examiner

*Primary Examiner*—James Harvey
(74) *Attorney, Agent, or Firm*—Birch, Stewart, Kolasch & Birch, LLP

(57) ABSTRACT

An electrical connector includes a housing defining a plurality of terminal-receiving passages therein and two passages at the opposite sides. The passages are open at the front end and close at the back end. A plurality of terminals is contained in the terminal-receiving passages and a pair of latches is received in the two passages respectively. A shelter having a top plate and a bottom plate encloses the housing. The opposite sides of the bottom plate extend a mount prong respectively. Each latch includes an arm, a latching section projecting at one end of the arm and a welding portion at the other end. The latching section projects out of the passage sidewards and the welding portion extends forwards beyond the passage for contacting with the mount prong of the shelter.

7 Claims, 6 Drawing Sheets

ELECTRICAL CONNECTOR

BACKGROUND OF THE INVENTION

1. Field of the Invention

The present invention relates generally to an electrical connector and more particularly to an electrical connector having a latch mechanism to provide reliable electrical connection.

2. The Related Art

Electrical connectors are widely applied in our everyday life as more and more electronic products are used in the modern society. In general, an electrical connector comprises a housing, a plurality of terminals contained in numerous slots defined in the housing and a metal shelter engaging with the housing. In order to provide a reliable connection between a pair of electrical connectors, the improved electrical connector is usually designed to have latch mechanisms disposed on the shelter for ensuring the electrical connection steady and reliable.

However, in recent years, there has been an increased demand for connectors smaller and lighter in electronic products designs. The latch mechanisms of conventional electrical connectors are assembled to the shelters, which makes the connectors large and not suitable to new products, therefore, the trend of designing smaller and lighter products is not suited. Hence, it is desired to provide an electrical connector smaller for fitting the trend of designing smaller and lighter products.

SUMMARY OF THE INVENTION

In view of the foregoing, the present invention is proposed to provide a smaller electrical connector that overcomes the disadvantage mentioned above.

The present invention of electrical connector includes a housing, a plurality of terminals, a pair of latches and a shelter. The housing defines a plurality of terminal-receiving passages therein and two longitudinal passages at the opposite sides. The inner side of each passage defines a blocking passage communicating with the corresponding passage outwards. The terminals are received in the respective terminal-receiving passages. The latches are received in the respective passages. Each latch has a longish arm. The arm protrudes sidewards at the back end to form a latching section beyond the passage and extends a welding portion beyond the passage forwards at the front end. The arm protrudes a positioning tab received in the blocking passage sidewards in the opposite direction of the latching section at the front end. The shelter encloses the housing, which has a top plate and a bottom plate. Two mount prongs extend out at the opposite sides of the bottom plate to contact with the bottom of the welding portions of the latches.

As described above, by containing the latches in the passages defined at the opposite sides of the housing, the electrical connector is made suitable for being used in smaller and lighter electronic products and conquers the disadvantage of conventional connectors.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
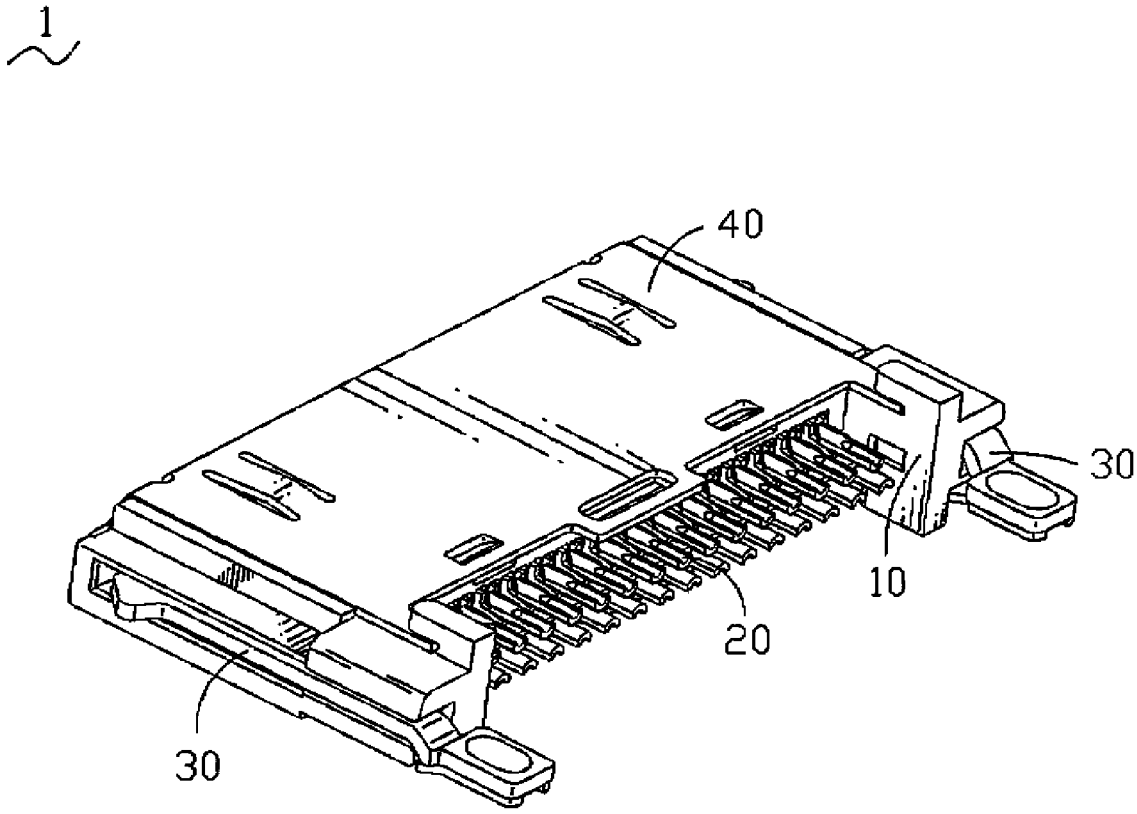
FIG. 1 is a perspective view of an electrical connector in accordance with the present invention.
Figure 2:
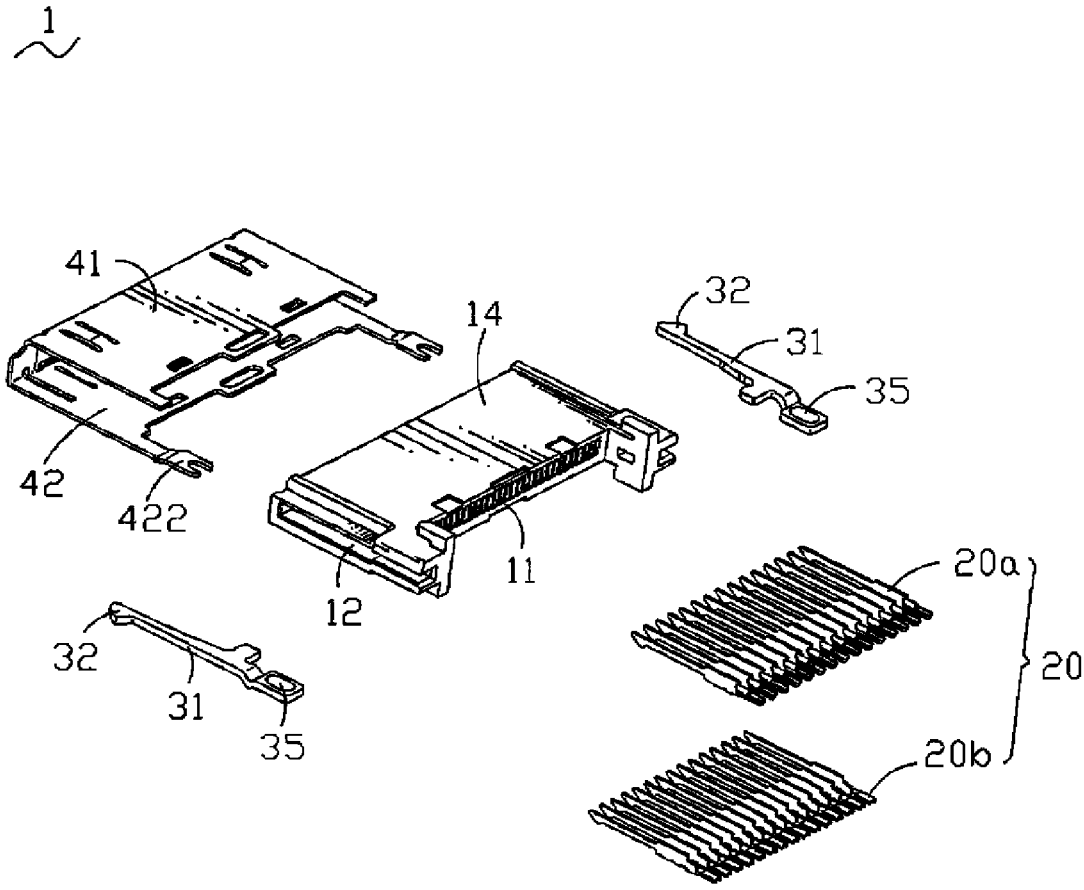
FIG. 2 is an exploded view of the electrical connector in accordance with the present invention.

Referring to FIGS. 1 and 2, an electrical connector 1 according to the present invention includes a housing 10, a plurality of terminals 20 received in the housing 10, a pair of latches 30 received in the housing 10, and a shelter 40 engaging with the housing 10.

Figure 3:
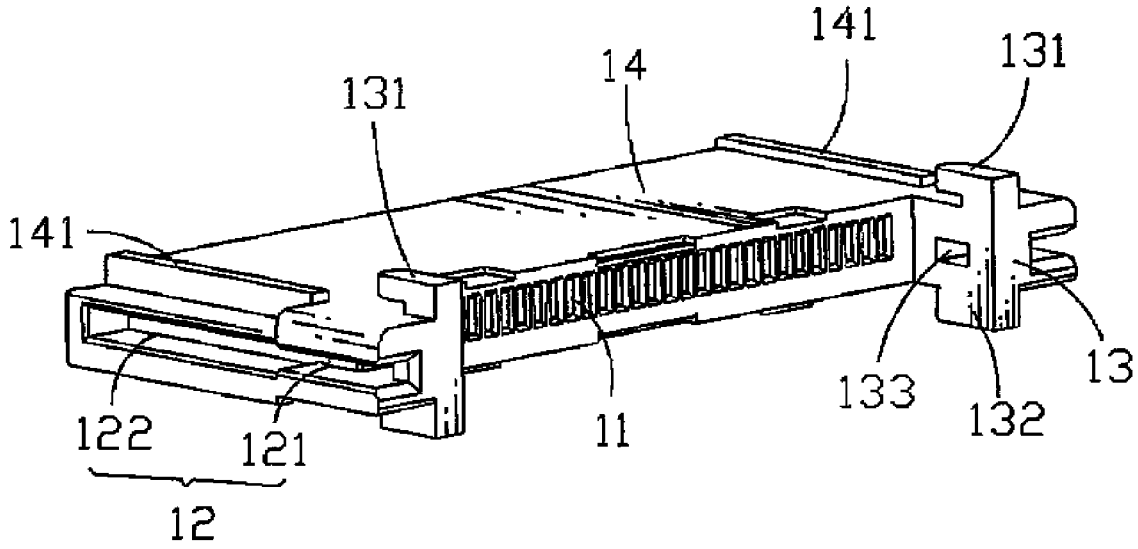
FIG. 3 is a perspective view of a housing of the electrical connector in accordance with the present invention.

With reference to FIG. 3, the housing 10 is a flat dielectric board. A plurality of terminal-receiving passages 11 arranged in a row is defined through the housing 10. A pair of parallel passages 12 is defined at the two opposite sides of the housing 10. Each of the passages 12 comprises a first slot 121 and a second slot 122. The first slot 121 has an open end at the front end. The second slot 122 has a lower bottom than the first slot 121, a front end communicating with the first slot 121, and a back end terminating at a back wall of the housing 10. The first slots 121 extend forwards beyond the housing 10 to form two side arms 13 at the opposite sides of the housing 10. Each side arm 13 extends upwards and downwards and then bends backwards respectively to form a first clutch 131 at its top end and a second clutch 132 at its bottom end. A blocking passage 133 communicating with the first slot 121 outwards is defined at the inner of each side arm 13. At a top surface 14 of the housing 10, two blocking walls 141 are set inside the coping of the corresponding second slots 122.

Figure 4:
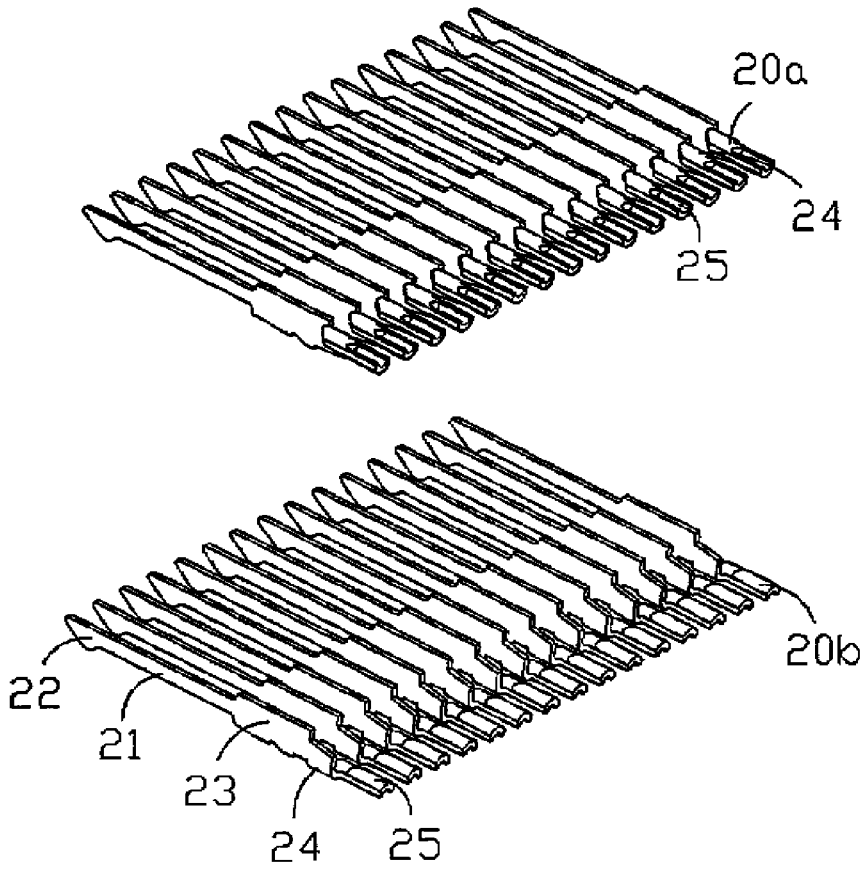
FIG. 4 is a perspective view of terminals of the electrical connector in accordance with the present invention.

Referring to FIG. 4, each terminal 20 comprises a straight portion 21, a contacting portion 22, a grasping portion 23, a bending portion 24 and a mounting portion 25. The straight portion 21 extends backwards to form the contacting portion 22, and extends forwards to form the wider grasping portion 23. The grasping portion 23 extends forwards and shrinks to be narrower at its front end, and then bends at one side to form a bending portion 24 of the terminal 20. The bending portion 24 then extends forwards flatly to form a mounting portion 25 for electrically connecting with wires or PCBs (not shown).

The plurality of terminals 20 can be divided into first terminals 20*a* and second terminals 20*b*. The difference between the first and second terminals 20*a*, 20*b* lies in their bending portions 24. The bending portions 24 of the first terminals 20*a* are formed by the grasping portions 23 bending sidewards at the top ends; and those of the second terminals 20*b* are formed by the grasping portions 23 bending towards the opposite side at the bottom ends. In assembly, the first terminals 20*a* and second terminals 20*b* are staggered in the terminal-receiving passages 11, so that the mounting portions 25 are arranged into two lines for better connecting with wires or PCBs.

Figure 5:
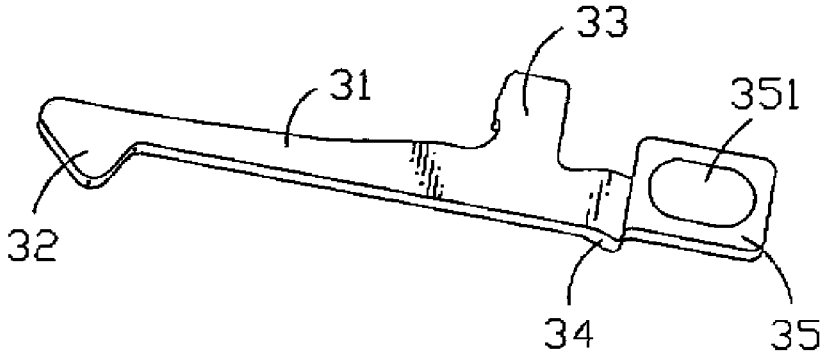
FIG. 5 is a perspective view of a latch of the electrical connector in accordance with the present invention.

Referring to FIG. 5, each latch 30 comprises a longish arm 31. The arm 31 protrudes sidewards at the back end to form a latching section 32, and bends downwards and then upward to form a bending portion 34 at the other end. The bending portion 34 connects a rectangular metal board as a welding portion 35 at the front end. On the middle part of the welding portion 35, it smoothly projects a heave 351. Further more, the arm 31 projects a positioning tab 33 sidewards in the opposite direction of the latching section 32 at the front end.

Figure 6:
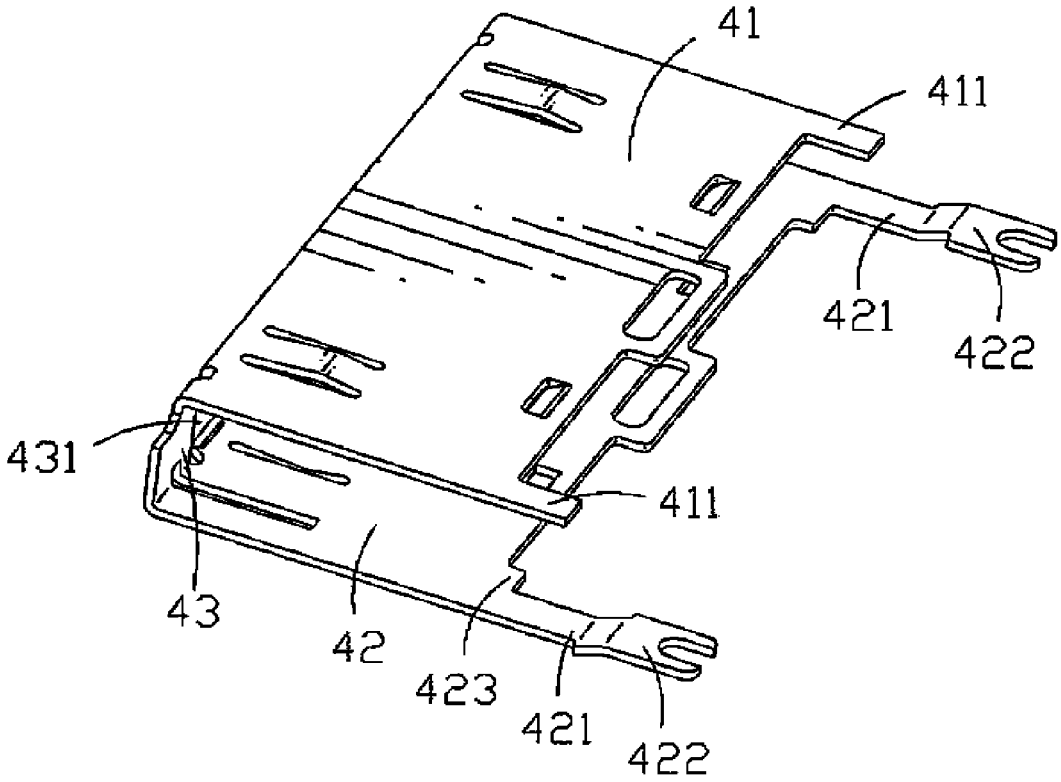
FIG. 6 is a perspective view of a shelter of the electrical connector in accordance with the present invention.

Please referring to FIG. 6, the shelter 40 made of metal materials comprises a top plate 41, a wider bottom plate 42 and a back plate 43 vertically connecting the top plate 41 and bottom plate 42 at their back end. A transverse opening 431 is defined in the back plate 43 for allowing the contacting portions 22 of the terminals 20 to connect with a mating connector (not shown). The top plate 41 flatly extends two lamelliform clasps 411 at the two opposite sides. A mount projection 421 below each clasp 411 extends at the opposite sides of the bottom plate 42. At the front end, each mount projection 421 bends upward and then extends horizontally to form a furcate mount prong 422 at the front end. What's more, a slice 423 is formed at the base of each mount projection 421 merging to the front end of the bottom plate 42.

Figure 7:
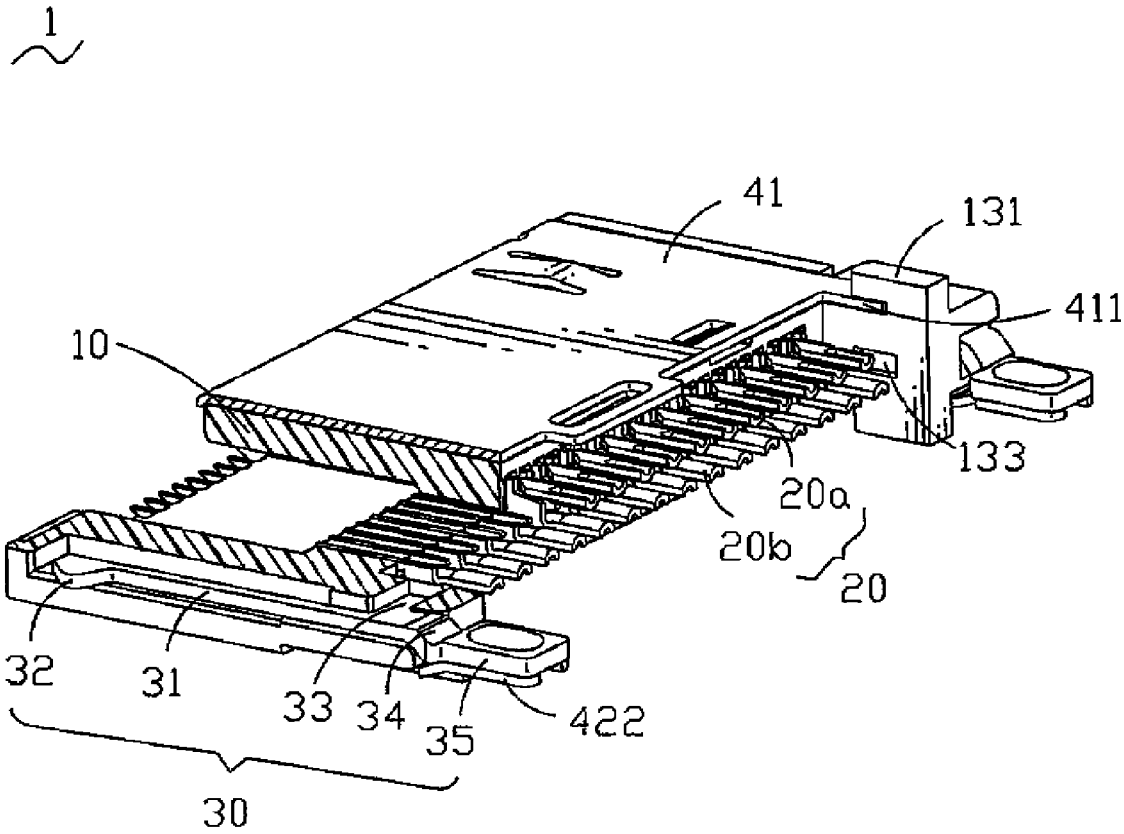
FIG. 7 is a cross-sectional view of the electrical connector with the latch in accordance with the present invention.

As shown in FIG. 7, in assembly, the terminals 20 are received in the terminal-receiving passages 11 respectively with their mounting portions 25 exposed out of the housing 10 in two lines for electrically connecting with PCBs. The latches 30 are contained in the passages 12 at the opposite sides of the housing 10. The latching section 32 of each latch 30 projects outwards beyond the passage 12 to clutch the mating connector. The welding portion 35 extends beyond the passage 12 from the front end. The positioning tab 33 of each latch 30 is inserted into the corresponding blocking passage 133 of the housing 10 ensuring the latch 30 fixed in the passage 12 steadily.

FIGS. 1 and 7 show how the shelter 40 encloses the housing 10. The top plate 41, bottom plate 42 and back plate 43 form a space together to contain the housing 10 therebetween. The top plate 31 is blocked between the blocking walls 141 on the top surface 14 of the housing 10; and the two clasps 411 are embedded in the two first clutches 131 of the side arms 13. The two mount projections 421 are clipped by the respective second clutches 132; the two slices 423 are inserted into the second clutches 132. The two mount projections 421 extend to the front of the housing 10 from the bottom. The mount prongs 422 are contacted and welded to the bottom of the welding portions 35 of the latches 30.

While the electrical connector 1 is connected to the mating connector, the latching sections 32 of the latches 30 would be pressed and compressed into the passages 12 of the housing 10. Then, under its elasticity, the latches 30 would block the corresponding mechanism of the mating connector, making the electrical connector 1 be assembled steadily in an electronic product (not shown).

As described above, by containing the latches 30 in the passages 12 defined at the opposite sides of the housing 10, the electrical connector 1 becomes smaller in volume, which makes it suitable for being used in smaller and lighter electronic products. Hence, more spare space is saved in the electronic products for further designs.

Although preferred embodiment of the present invention have been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. An electrical connector comprising:

a housing, defining a plurality of terminal-receiving passages therein and two longitudinal passages at the opposite sides, the inner side of each longitudinal passage defining a blocking passage communicating with the corresponding longitudinal passage outwards;

a plurality of terminals, received in the respective terminal-receiving passages;

a pair of latches received in the respective longitudinal passages, each having a longish arm, the arm protruding sidewards at the back end to form a latching section beyond the passage, and extending a welding portion beyond the longitudinal passage forwards at the front end, the arm protruding a positioning tab received in the blocking passage sidewards in the opposite direction of the latching section at the front end; and a shelter enclosing the housing, having a top plate and a bottom plate, two mount prongs extending out at the opposite sides of the bottom plate to contact with the bottom of the welding portions of the latches.

2. The electrical connector as claimed in claim 1, wherein the arm bends downwards and then upwards to form a bending portion at the front end, the bending portion connects a rectangular metal board as a welding portion at the front end.

3. The electrical connector as claimed in claim 1, wherein the welding portion of the latch projects upwards to form a heave smoothly on the middle.

4. The electrical connector as claimed in claim 1, wherein the mount prongs of the shelter and the corresponding welding portions of the latches are welded with each other.

5. The electrical connector as claimed in claim 1, wherein the two longitudinal passages extend forwards beyond the housing to form two side arms at the opposite sides of the housing.

6. The electrical connector as claimed in claim 5, wherein each side arm extends upwards and downwards and then bends backwards respectively to form a first clutch at its top end and a second clutch at its bottom end, two blocking walls are set at the two sides of a top surface of the housing, the top plate of the shelter flatly extends two clasps at the two opposite sides, a mount projection below each clasp extends at the opposite sides of the bottom plate, each mount projection bends upwards and then extends horizontally to form each of the two mount prongs, each of the mount prongs is a furcate mount prong at the front end, a slice is formed at the base of each mount projection merging to the front end of the bottom plate, the top plate blocked between the blocking walls, the two clasps embedded in the two first clutches of the side arms, the two mount projections clipped by the second clutches respectively, the two slices inserted into the second clutches, the two mount projections extending to the front of the housing from the bottom.

7. The electrical connector as claimed in claim 5, wherein each of the passages comprises a first slot and a second slot, the first slot having an open end at the front part, the second slot having a lower bottom than the first slot, a front end communicating with the first slot, and a close end at the back, each of the side arms defines the blocking passage communicating with the first slot at the inner of each side arm.

* * * * *